United States Patent [19]

Mobberley et al.

[11] Patent Number: 4,643,329

[45] Date of Patent: Feb. 17, 1987

[54] TAMPER EVIDENT CONTAINER

[76] Inventors: Laura P. Mobberley, 3715 Harrison, Kansas City, Mo. 64109; Ernest L. Smith, 5910 N. Adrian Ter., Kansas City, Mo. 64151; George E. MacEwen, 729 NW. 60th, Apt. 11, Kansas City, Mo. 64118

[21] Appl. No.: 842,315

[22] Filed: Mar. 21, 1986

[51] Int. Cl.[4] ..... B65D 51/20

[52] U.S. Cl. ..... 220/257; 220/270; 220/276; 220/307

[58] Field of Search ..... 220/257, 270, 276, 307; 229/43

[56] References Cited

U.S. PATENT DOCUMENTS

| | | | |
|---|---|---|---|
| 4,087,018 | 5/1978 | Tebbutt | 220/257 |
| 4,350,263 | 9/1982 | Hoffman | 229/43 |
| 4,488,658 | 12/1984 | Smith et al. | 220/276 |
| 4,493,432 | 1/1985 | Smith | 220/270 |
| 4,555,056 | 11/1985 | Bernhardt | 220/257 |

*Primary Examiner*—George T. Hall

*Attorney, Agent, or Firm*—Kokjer, Kircher, Bradley, Wharton, Bowman & Johnson

[57] ABSTRACT

A tamper evident package for dairy products and other foods and consumables. A conventional container and lid are included, along with a plastic disk which is wedged in place on top of the lid with the edge of the disk fitting in a channel in order to prevent removal of the lid. The disk has a frangible center section which must be broken away before the disk can be removed to release the lid. The presence of the disk intact on the lid indicates that the container has not been opened, while absence or mutilation of the disk provides visible evidence of tampering.

20 Claims, 10 Drawing Figures

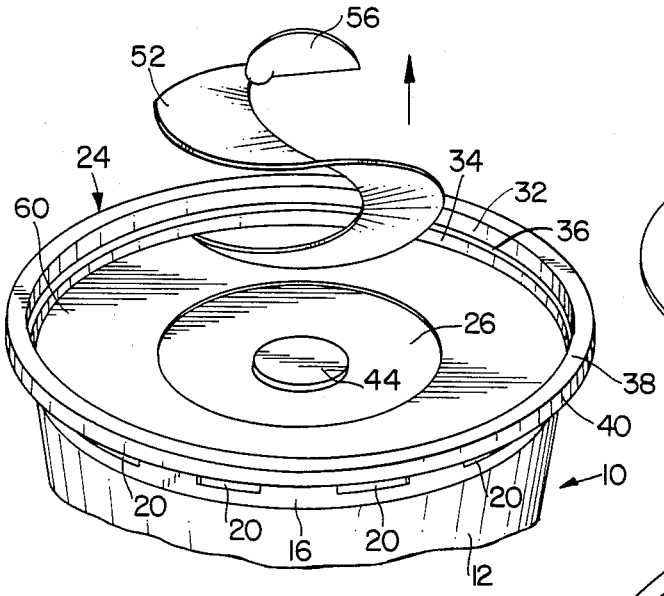
FIG.6
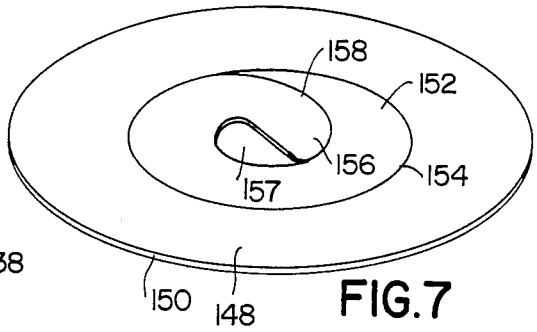
FIG.7
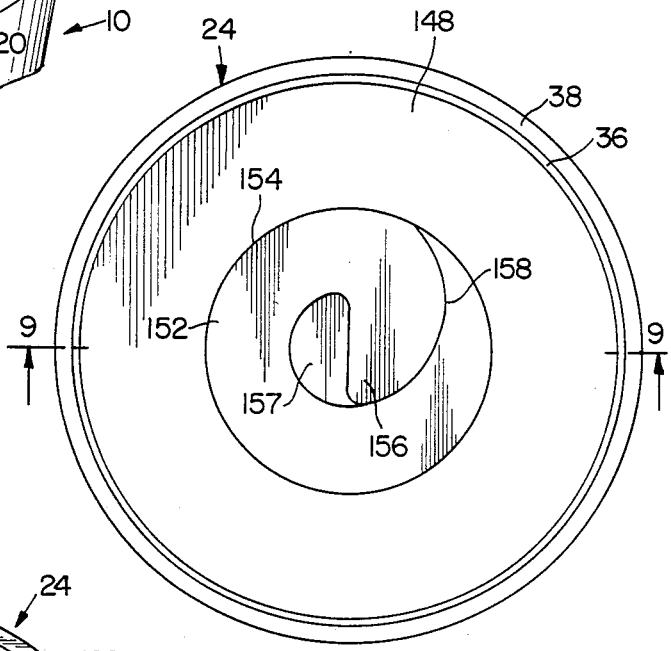
FIG.8
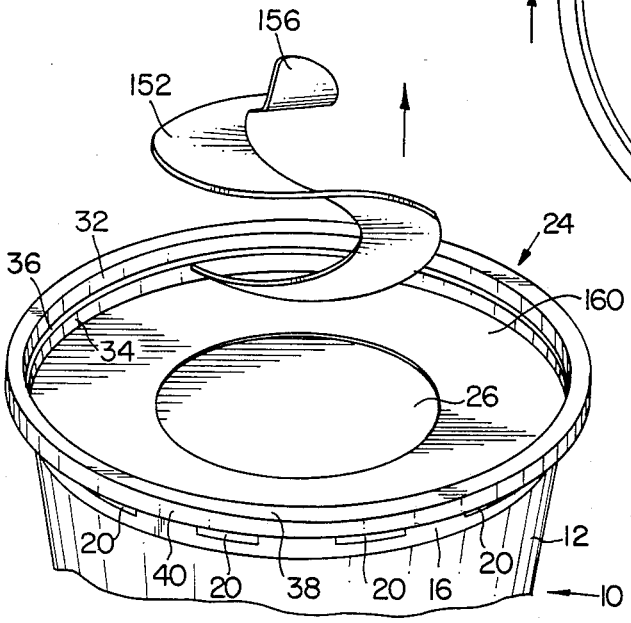
FIG. 10
FIG.9
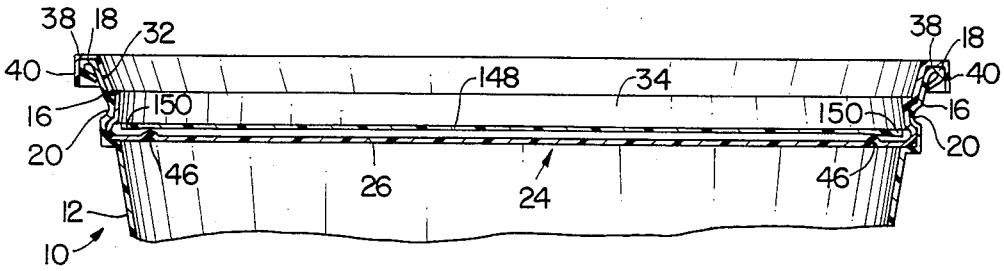

TAMPER EVIDENT CONTAINER

BACKGROUND OF THE INVENTION

This invention relates in general to packaging and more particularly to a container for foods and other consumable products which is constructed in a manner to provide visual evidence that the container has been opened.

The containers for cottage cheese, sour cream, yogurt, ice cream, and other food products are normally relatively inexpensive "tub" type containers that are typically formed from coated paperboard or injection molded, or thermoformed thermoplastic materials such as polyethylene or polystyrene. The container is provided with a lid which must fit tightly on the container in order to give the product a prolonged shelf life. The periphery of the lid and the rim of the container are usually formed to mechanically interlock with one another in order to hold the lid in place and at the same time effectively seal the container contents. The lid can be removed to provide access to the container contents and can be replaced by pressing it back onto the container to again seal the contents.

One problem with conventional food containers of this type is that the lid can be removed and the contents can be tampered with while the package is on a store shelf or elsewhere. After the lid has been replaced, there is no visible indication given that tampering has occurred, and potential purchasers have no way of knowing that tampering may have taken place.

In the past, there have been well publicized incidents involving the intentional adulteration of consumable products with poisons and other harmful substances. These incidents and the possibility of other types of tampering have caused the packaging industry to make efforts at providing containers which are either tamper proof or tamper evident. Although tamper evident containers can be opened when still on the shelf in a store, the fact that they have been opened is evidenced by an easily visible indication alerting the public to the fact that tampering has taken place and the contents may be contaminated. Examples of tamper evident containers are found in U.S. Pat. Nos. 4,190,175 to Allen, 4,146,148 to Dwinell et al., 4,488,658 to Smith et al., and 4,493,432 to Smith.

All of the known food packages of this type require that an actual part of the lid itself be torn or broken away before the container can be opened. Consequently, the lids must be specially constructed in order to provide them with the special tear away sections. This requires special manufacturing operations for forming the lids, along with all of the other problems and costs associated with designing, developing and manufacturing a completely new lid construction.

SUMMARY OF THE INVENTION

The present invention is directed to a tamper evident container for the packaging of foods and other products, and it is particularly characterized by its ability to employ the same lids that have previously been used. As a result, the costs of providing a completely new lid are avoided. At the same time, the container construction provides clear visual evidence when the container has been previously opened in order to alert prospective purchasers to that fact.

In accordance with the invention, a conventional container for holding foods and other consumable products has a removable lid which is likewise constructed conventionally. The lid may be held in place on the container by the close fit of a peripheral bead on the lid in a grooved area of the container wall. The tamper evident feature of the package is provided by a special plastic disk insert which is fitted on top of the lid with the edge of the disk received in a channel formed on the inside of the peripheral bead of the lid. The disk is wedged tightly in place and is stiff and rigid enough to prevent the bead from releasing from the groove. The disk thus acts to prevent removal of the lid and opening of the package so long as the disk remains in place.

The disk has a frangible circle in its center defined within a weakened score line. A tab located in the center of the frangible circle provides a convenient finger grip which may be pulled in order to break the frangible section away from the disk along the circular score line. Once the frangible circle has been broken away, the disk is reduced to an annular ring that may be easily pried away from the lid.

This construction requires removal of the disk before the package can be initially opened, and the disk can only be removed by first breaking away the frangible circle. Thus, the presence of the disk in place and intact provides evidence that the package has not previously been opened. Conversely, if the package is on a store shelf and the disk is missing or damaged, the consumer is alerted to the fact that tampering may have taken place and possibly dangerous contaminants may have been introduced into the container.

DESCRIPTION OF THE DRAWINGS

In the accompanying drawings which form a part of the specification and are to be read in conjunction therewith and in which like reference numerals are used to indicate like parts in the various views:

FIG. 6 is a fragmentary perspective view similar to FIG. 5, but showing the frangible section of the disk broken away;

FIG. 7 is a perspective view of a plastic disk constructed according to another embodiment of the present invention;

FIG. 8 is a top plan view showing the disk of FIG. 7 in place on a lid applied to the container;

FIG. 9 is a fragmentary sectional view on an enlarged scale taken generally along line 9—9 of FIG. 8 in the direction of the arrows; and FIG. 10 is a fragmentary perspective view showing the disk of FIG. 7 in place on the lid, with the frangible center section of the disk broken away.

DETAILED DESCRIPTION OF THE INVENTION

Figure 1:
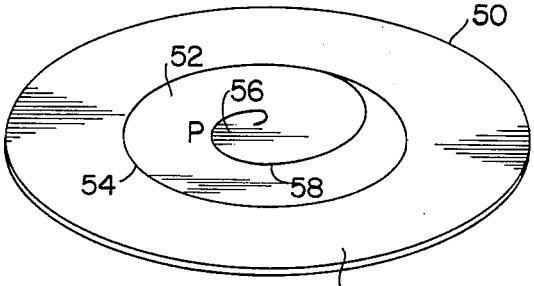
FIG. 1 is a perspective view of a plastic disk which is included in a tamper evident container constructed according to one embodiment of the present invention.

Referring now to the drawings in more detail, numeral 10 generally designates a container for the packaging of perishable foods such as dairy products in the nature of cottage cheese, sour cream, ice cream or yogurt. The container 10 may be formed from coated paperboard, injection molded, or thermoformed thermoplastic, although other materials are possible. The container 10 is a "tub" type container having a frustoconical sidewall 12. A discoidal bottom (not shown) closes the bottom of the container.

It should be understood that the container 10 may serve to hold other types of food products or other consumable products. It should also be understood that the container can have configurations other than that shown in the drawings.

Figure 4:
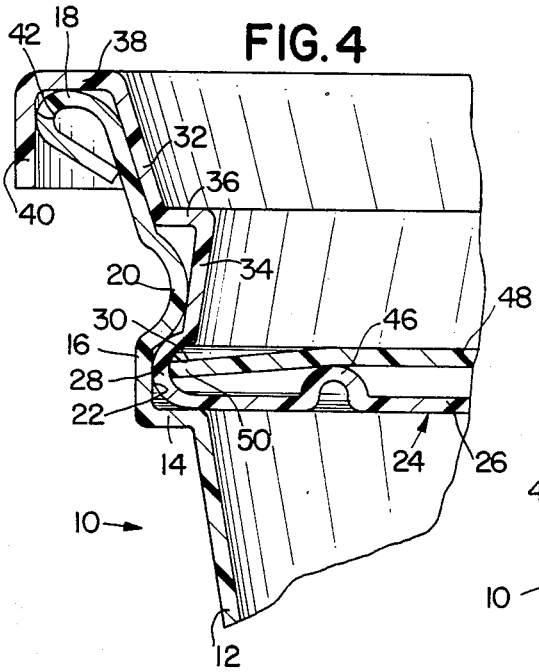
FIG. 4 is a fragmentary sectional view on an enlarged scale showing the manner in which the lid disk and container rim fit together when the package is assembled.
Figure 5:
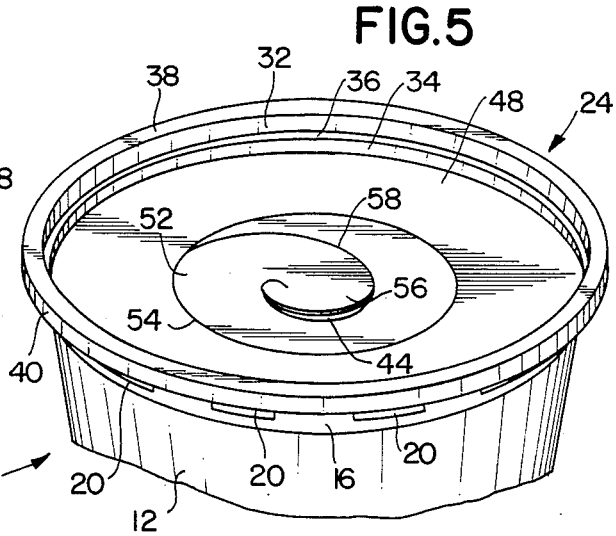
FIG. 5 is a fragmentary perspective view showing the disk in place on the lid, with the frangible center section of the disk pressed downwardly to provide access to a tab which is used to break away the frangible section.

FIG. 4 best illustrates the configuration of the upper edge portion of the container wall 12. An annular shoulder 14 extends outwardly from the upper edge of the main container wall and connects at its outer edge with a generally vertical wall section 16. An outwardly rolled rim 18 is formed on the top edge of the wall section 16 to form the upper rim of the container 10. A plurality of small ribs 20 project inwardly from wall section 16 at locations intermediate its top and bottom ends. The ribs 20 are spaced apart from one another in a uniform manner around the circumference of the container, as best shown in FIGS. 5 and 6. Referring again to FIG. 4 in particular, a groove 22 is formed immediately inwardly of the lower portion of wall 16 above shoulder 14 and below ribs 20. Groove 22 is generally annular and has an open side which faces into the container.

Access to the contents of container 10 is provided through an open top of the container which is defined within the rim 18. The contents of the container may be sealed by a removable lid generally designated by numeral 24. Lid 24 has a flat, discoidal body 26 provided on its periphery with a bead 28. The body 26 of the lid is large enough to span the open top of container 10, and the periphery of body 26 overlies shoulder 14. Bead 28 extends completely around the periphery of the body 26 and has a size and location to fit closely in the groove 22 formed on the container wall. The close fit of bead 28 in groove 22 retains lid 24 securely in place to cover the top of the container and enclose its contents.

An annular groove or channel 30 is formed immediately inside of the bead 28. Channel 30 opens inwardly with its open side facing toward the center of the lid body 26. Bead 28 can be deformed inwardly into channel 30 far enough to permit the bead to be removed from groove 22 and to pass the ribs 20, thereby releasing lid 24 so that it can be removed from the top of container 10.

Above bead 28, the peripheral portion of lid 24 includes upper and lower wall sections 32 and 34 which are connected by a generally horizontal shoulder 36. Wall section 32 extends generally along the inside surface of the upper part of wall 16, while wall section 34 is located inwardly of the ribs 20. A horizontal flange 38 extends outwardly from the upper edge of wall section 32 and is located immediately above the rolled rim 18 when the lid is applied to the container. An annular skirt 40 projects downwardly from the outer edge of flange 38 and is located immediately outwardly of rim 18. The rim 18 fits tightly within a groove 42 formed below flange 38 and between wall section 32 and skirt 40. The tight fit of rim 18 in groove 42 assists in holding lid 24 in place on the container and prevents wall section 16 from deflecting when the lid is in place.

Figure 2:
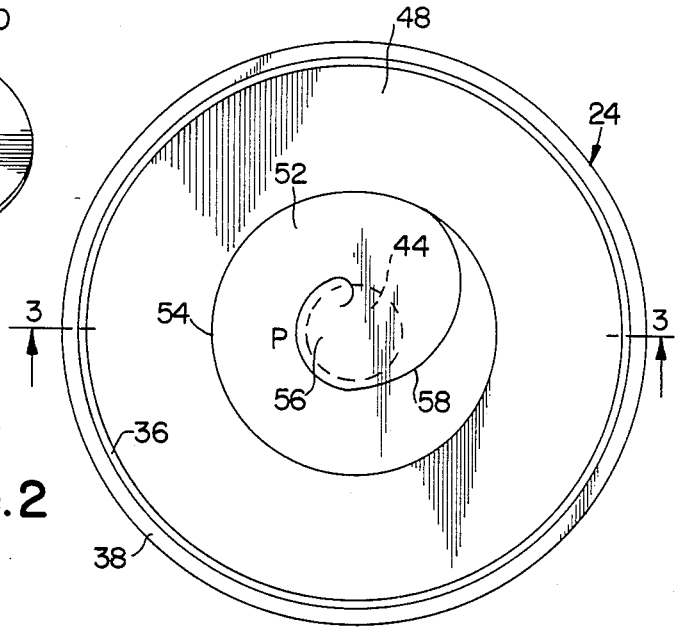
FIG. 2 is a top plan view showing the disk in place on top of a lid applied to the container.
Figure 3:
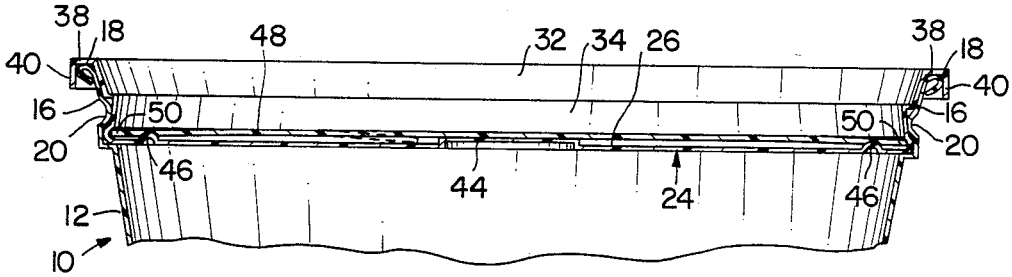
FIG. 3 is a fragmentary sectional view taken generally along line 3—3 of FIG. 2 in the direction of the arrows.

As shown in FIG. 2, 3 and 6, a circular button 44 is formed at the center of lid 24 and projects upwardly above the lid body 26. The button 44 has a flat top surface which presents a circular edge. An annular rib 46 projects upwardly from body 26 at a location spaced inwardly from the peripheral bead 28.

As thus far described, the container 10 and lid 24 are constructed conventionally. The container and lid are preferably each formed in a single integral piece, and the same material may be used for each.

In accordance with the present invention, the package is provided with a plate member which takes the form of a plastic disk 48 constructed to provide visual evidence of whether or not tampering with the container and its contents has taken place. The disk 48 is circular and is preferably formed of a plastic material that may be, if desired, somewhat stiffer and more rigid than the container 10 or lid 26. Disk 48 has substantially the same size and shape as the body 26 of lid 24. Disk 48 is inserted on top of body 26 and has a circular edge 50 that enters the channel 30 formed inside of bead 28 on the periphery of the lid. Disk 48 is wedged tightly in this position after the container has been filled and the lid 24 has been initially applied. The edge 50 is in direct contact with the inside of bead 28 where the edge is inaccessible due to the small size of the channel 30. Disk 48 is stiff enough to resist inward deformation of bead 28 into channel 30, and the bead 28 cannot be removed from groove 22 when disk 48 is in place. Consequently, it is necessary to remove disk 48 before the lid 24 can be removed to initially open the container.

Disk 48 has a circular frangible section 52 formed in the center of the disk within a circular score line 54. The score line 54 provides a weakened area which may be severed in order to break the frangible section 52 away from the remainder of the disk.

The frangible section 52 is provided with a tab 56 located at the center of disk 50. Tab 52 has a curved edge defined by part of another score line 58 which has a generally spiral shape and which merges at its outer end with the circular score line 54. The curved edge of tab 56 is located immediately above part of the curved edge of the button 44, as best shown in FIG. 2.

As previously indicated, when the container 10 is initially filled and closed by lid 24, disk 48 is inserted on top of the lid in the position shown in FIG. 3. Initial opening of the package requires removal of disk 48. This is accomplished by initially pressing down on the part of the frangible section 52 which is identified by the letter P in FIG. 2. This area is located adjacent to the curved edge of tab 56. Button 44 prevents tab 56 from being depressed along with area P, so pressing on the area P severs that part of score line 58 which extends along the curved edge of the tab. The edge of the tab is then made inaccessible and can be gripped with the fingers and pulled upwardly. Upward pulling of the tab causes the entire score line 58 to sever, followed by severing of the circular score line 54. Once line 54 has been completely severed, the frangible section 52 is completely broken away from disk 48, leaving only an annular ring 60 (see FIG. 6). The ring 60 can be easily pried away from lid 24 with the fingers.

After disk 48 has been removed in this fashion, lid 24 can be removed and can be replaced if desired. When replaced, the lid seals the contents of container 10.

Disk 48 provides visual evidence as to whether or not tampering has occurred to the contents of the container 10. Since disk 48 must be removed in order to initially open the container, and since it is necessary to remove the frangible section 62 in order to remove disk 48, the presence of the disk intact on the container lid provides assurance that the container has not been opened. If disk 48 is absent from the container, or if the frangible section 52 has been severed from the disk, prospective purchasers are alerted to the fact that the container may have been opened and tampering may have taken place.

FIGS. 7–10 illustrate an alternative embodiment of the invention in which the container 10 and lid 24 are constructed in the same manner indicated for the embodiment of FIGS. 1–6, except that the button 44 is absent from body 26 of the lid. The same reference numerals are used in FIGS. 7–10 to identify the earlier described parts of the container and lid.

The embodiments shown in FIGS. 7–10 makes use of a circular plate or disk 148 which functions in the same manner as disk 48 and which is constructed in the same manner for the most part. The only significant difference is that the circular frangible section 152 of disk 148 is provided with a semi-circular cutout 157 at its center. A tab 156 is formed adjacent to the flat edge of cutout 157, and a generally spiral score line 158 extends adjacent to tab 156 and merges with the circular score line 154 which connects the frangible section 162 with the remainder of the disk 148.

In use, disk 148 is inserted on top of the lid body 26 and functions to retain the lid 24 in place on container 10. The edge 150 is received in channel 30 to prevent bead 28 from compressing into the channel enough to release from groove 22. Initial opening of the container requires removal of the disk 148, and this is accomplished by inserting the finger into the cutout 157, grasping the edge of tab 156, and pulling upwardly on the tab to sever the spiral score line 158 and then the circular score line 154. This breaks the frangible section 152 away from the remainder of the disk 148 and leaves only an annular ring 160 on the container, as shown in FIG. 10. Ring 160 can easily be pried away from the lid with the fingers, and lid 26 can then be removed to provide access to the contents of the container. It should be noted that the rib 46 holds the center portion of disk 148 a short distance above the body 26 of the lid. This permits the edge of tab 156 to be easily grasped by inserting the finger into the cutout 157. The pressure of disk 148 on the package intact again provides assurance that the container has not been opened, while its absence or the absence of the frangible section indicates tampering.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. A tamper evident container assembly comprising:

a container having a hollow interior for holding materials packaged therein and an open top providing access to the container contents when exposed;

a removable lid applicable to the container to close the top of the container, said lid covering said top of the container when applied thereto and presenting a peripheral portion engaging the container in a manner to releaseably retain the lid on the container, said peripheral portion being deformable to release from the container to permit removal of the lid; and a plate member on the lid acting against said peripheral portion of the lid in a manner to retain said peripheral portion against deformation, said plate member fitting tightly on the lid and having a frangible section which must be broken before the plate member can be removed from the lid to permit removal of the latter from the container.

2. The invention of claim 1, including a projection on said lid located adjacent said frangible section of the plate member to facilitate initial breaking of the frangible section.

3. The invention of claim 1, wherein said frangible section includes a tab for facilitating breakage of said frangible section.

4. The invention of claim 3, including a cutout in said frangible section adjacent said tab providing a finger opening to facilitate gripping of the tab with the fingers.

5. The invention of claim 3, including:

a score line connecting an edge of said tab to the remainder of the frangible section; and a projection on said lid located adjacent said score line to effect severing of said edge along the score line when the frangible section is pressed at a location adjacent the score line.

6. The invention of claim 1, wherein:

said frangible section is located in a center portion of the plate member; and said plate member has a score line connecting said frangible section with the remainder of the plate member, said score line providing a weak area along which the frangible section may be severed for removal from the plate member.

7. The invention of claim 6, including a tab on said frangible section providing a finger grip to facilitate severing of the score line upon pulling of the tab.

8. The invention of claim 7, including a spiral score line on said frangible section extending from said tab to the first mentioned score line.

9. The invention of claim 1, wherein:

said peripheral portion of the lid comprises a bead; and said container has a wall presenting a groove therein for closely receiving said bead in a manner to releaseably hold the lid on the container.

10. The invention of claim 9, wherein said plate member has a size and shape to wedge tightly against said bead to resist deformation thereof.

11. The invention of claim 10, wherein:

said peripheral portion of the lid presents a channel adjacent said bead, said channel opening inwardly; and said plate member has an edge fitting in said channel to prevent the bead from being deformed into the channel.

12. A tamper evident container assembly comprising:

a container having a hollow interior formed within a wall of the container and an open top providing access to the interior and the contents thereof when exposed;

a removable lid applicable to the container to cover said top thereof and enclose the contents of the container;

mating portions on said lid and said container wall which interfit in a manner to releaseably retain the lid on the container, the mating portion on said lid being releaseable from the mating portion on said wall to permit removal of the lid from the container;

a plate having a shape similar to the shape of the lid and a size to fit on the lid with an edge portion of the plate in engagement with said mating portion of the lid to prevent release of said mating portion of the lid from said mating portion of the container wall, thereby securing the lid on the container; and a frangible section of said plate which is situated at an accessible location and which must be broken away from the plate before the plate can be removed from the lid, whereby the presence of said frangible section on the plate intact provides assurance that the container has not been opened.

13. The invention of claim 12, wherein said mating portions include a groove presented in the wall of the container and a bead on said lid fitting closely in said groove.

14. The invention of claim 13, wherein:

said lid presents an inwardly opening channel adjacent said bead into which the bead is deformable to release from said groove; and said plate has a size and shape to span the lid and said edge of the lid is disposed in said channel to prevent deformation of the bead into the channel unless the plate is first removed from the lid.

15. A tamper evident food package comprising:

a container having a container wall and an interior formed within the wall for containing foods, said container wall having a substantially circular rim extending around an open top of the container which provides access to the contents of the container when exposed;

a generally disk shaped lid applicable to the container to cover said top thereof;

a peripheral portion of said lid presenting a bead thereon;

a groove in said container wall having a size and shape to closely receive said bead in a manner to retain the lid on the container, said bead being releaseable from said groove to permit removal of the lid from the container;

a disk having a size to span the top of the container on top of the lid and presenting an edge fitting tightly against said bead to prevent release of same from the groove when said disk is in place on the lid; and a frangible section of said disk which must be broken to permit detachment of the disk from the lid, said frangible section being at a visible and accessible location.

16. The invention of claim 15, wherein said frangible section of the disk is substantially circular and is located centrally on the disk.

17. The invention of claim 16, including a generally circular score line connecting said frangible section of the disk with an annular portion thereof which is removable from the lid when said score line has been severed to detach said frangible section.

18. The invention of claim 17, including a tab on said frangible section located substantially centrally thereon to provide a finger grip for severing the score line when the tab is pulled.

19. The invention of claim 18, including:

a curved edge of said tab; and a button on said lid having a surface underlying said curved edge of the tab to provide access to said curved edge when the frangible section is pressed at a location adjacent the curved edge.

20. The invention of claim 18, including a cutout in said frangible section adjacent said tab providing a finger opening to facilitate gripping of the tab with the fingers.

* * * * *